US007438289B2

(12) United States Patent
Wada

(10) Patent No.: US 7,438,289 B2
(45) Date of Patent: Oct. 21, 2008

(54) SHEET MATERIAL STACKING APPARATUS

(75) Inventor: Fumiaki Wada, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 542 days.

(21) Appl. No.: 11/057,368

(22) Filed: Feb. 15, 2005

(65) Prior Publication Data

US 2005/0212201 A1 Sep. 29, 2005

(30) Foreign Application Priority Data

Feb. 16, 2004 (JP) ..... 2004-038037

(51) Int. Cl.
*B65H 29/20* (2006.01)
*B65H 43/00* (2006.01)

(52) U.S. Cl. ..... 271/315; 271/176; 271/187

(58) Field of Classification Search ..... 271/176, 271/315, 178, 187, 258.01, 268.01
See application file for complete search history.

(56) References Cited

U.S. PATENT DOCUMENTS

| | | | | |
|---|---|---|---|---|
| 3,150,873 | A * | 9/1964 | MacGregor | 271/259 |
| 3,912,255 | A * | 10/1975 | McInerny | 271/315 |
| 4,088,314 | A * | 5/1978 | Phillips | 271/176 |
| 4,151,410 | A * | 4/1979 | McMillan et al. | 250/223 R |
| 4,244,565 | A * | 1/1981 | Geier | 271/176 |
| 4,332,462 | A * | 6/1982 | Yagasaki et al. | 399/17 |
| 4,511,136 | A * | 4/1985 | Yamada et al. | 271/187 |
| 4,593,896 | A * | 6/1986 | Nakamura | 271/186 |
| 4,638,993 | A * | 1/1987 | Granzow et al. | 271/315 |
| 4,790,526 | A * | 12/1988 | Egashira | 271/315 |
| 5,899,448 | A * | 5/1999 | Hosking | 271/3.08 |
| 6,494,447 | B2 * | 12/2002 | Myer, Sr. | 271/176 |
| 6,796,557 | B2 * | 9/2004 | Watanabe et al. | 271/176 |
| 2002/0113366 | A1 * | 8/2002 | Watanabe et al. | 271/315 |
| 2003/0121838 | A1 * | 7/2003 | Werner et al. | 209/534 |

FOREIGN PATENT DOCUMENTS

| | | |
|---|---|---|
| EP | 1 167 259 | 1/2002 |
| EP | 1 219 557 | 7/2002 |
| JP | 2001-48394 | 2/2001 |
| JP | 2003-267310 | 9/2003 |

* cited by examiner

*Primary Examiner*—Patrick Mackey
*Assistant Examiner*—Luis A Gonzalez
(74) *Attorney, Agent, or Firm*—Pillsbury Winthrop Shaw Pittman LLP

(57) ABSTRACT

A sheet material stacking apparatus comprises a shift sensor configured to detect the sheet conveyed by a branching path, a drop-down checking sensor configured to detect that sheet which reaches a scraping-out plate through the rotation of a rotatable blade-type runner, and a transport controller configured to, after a passage of a predetermined time following the detection of the sheet by the shift sensor, start detecting the sheet by using a drop-down checking sensor, and to stop stacking the sheet when the drop-down checking sensor detects no sheet.

2 Claims, 5 Drawing Sheets

(a) A position for the leading edge of the sheet to reach the forward end of the blade
(b) Position of the blade rotated through an angle of 60° (Start the checking by the drop-down sensor)
(c) Position of the blade rotated through an angle of 75° (Stop the checking by the drop-down sensor)
(1) Represent a first blade
(2) Represent a second blade
(3) Checking period by the drop-down sensor

SHEET MATERIAL STACKING APPARATUS

CROSS-REFERENCE TO RELATED APPLICATIONS

This application is based upon and claims the benefit of priority from prior Japanese Patent Application No. 2004-038037, filed Feb. 16, 2004, the entire contents of which are incorporated herein by reference.

BACKGROUND OF THE INVENTION

1. Field of the Invention

The present invention relates to a sheet material stacking apparatus provided on, for example, a bank note checking machine and configured to allow bank notes to be stacked there.

2. Description of the Related Art

The bank note checking machine includes various kinds of detecting devices and is adapted to, by moving the bank notes past these detecting devices, decide them as being a recirculatable fit note, a noncirculatable unfit note or a reject note, counterfeit and illegible. Those bank notes decided as being recirculatable are stacked in a fit note stacking device, those bank notes decided as being nonrecirculatable are stacked in an unfit note stacking device and those notes decided as being reject notes, counterfeit and illegible, are stacked in a reject note stacking device.

As shown, for example, in JPN PAT APPLN KOKAI PUBLICATION NO. 2001-48394, the fit and unfit bank note stacking apparatus have a rotatable blade-type runner configured to allow the bank note which is conveyed to enter into a blade-to-blade space for guidance. Such a sheet material guided through the rotation of the runner has its leading edge abutted against a scraping-out plate to allow the sheet to be scraped out of the blade-to-blade space of the runner and dropped down in a stacking box. When a predetermined number of (for example, 100) sheets are stacked within the stacking box, those stacked sheets are sent out onto a sealing section where they are sealed in a bundle.

Incidentally, the sheet which enters into the blade-to-blade space of the runner will sometimes fly out of the blade-to-blade space before it reaches the scraping-out plate. In this case, there is a risk that the sheet will not be stacked within the stacking box.

In the prior art apparatus, however, even if those bank notes are not stacked within the stacking box, they are counted as being stacked and conveyed to the next-stage sealing section where, in such a state as not to reach 100 sheets, these sheets are sealed in a bundle. Thus a problem arises with which there is no coincidence between the number of bank notes counted by the bank note checking machine and the number of bank notes sealed in a bundle.

BRIEF SUMMARY OF THE INVENTION

The present invention has been achieved with these situations in view and the object of the present invention according to one aspect provides a sheet material stacking apparatus which, even if the sheet which has entered a blade-to-blade space of the runner fails to reach a scraping-out device, can stop a stacking operation of the sheet and can, by doing so, prevent any number of sheets, other than a prescribed number, from being sealed in a bundle.

In another aspect of the present invention there is provided a sheet material stacking apparatus comprising a conveying device configured to convey a sheet material; a rotatable blade-type runner configured to allow the sheet which is conveyed by the conveying device to enter into a blade-to-blade space while being rotated and guide the sheet toward a predetermined direction; a scraping-out device configured to allow the sheet which is guided through the rotation of the runner to abut thereagainst and scrape the sheet out of the blade-to-blade space; a stacking section configured to allow the sheet which is scraped out by the scraping-out device to be stacked; a first detecting device configured to detect the sheet conveyed by the conveying device; a second detecting device configured to detect the sheet which reaches the scraping-out device through the rotation of the runner; and a control device configured to, after a passage of a predetermined time following the detection of the sheet by the first detecting device, start the detection of the sheet by the second detecting device and stop the stacking operation of the sheet based on the not detecting of the sheet by the second detecting device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described below with reference to the accompanying drawing.

Figure 1:
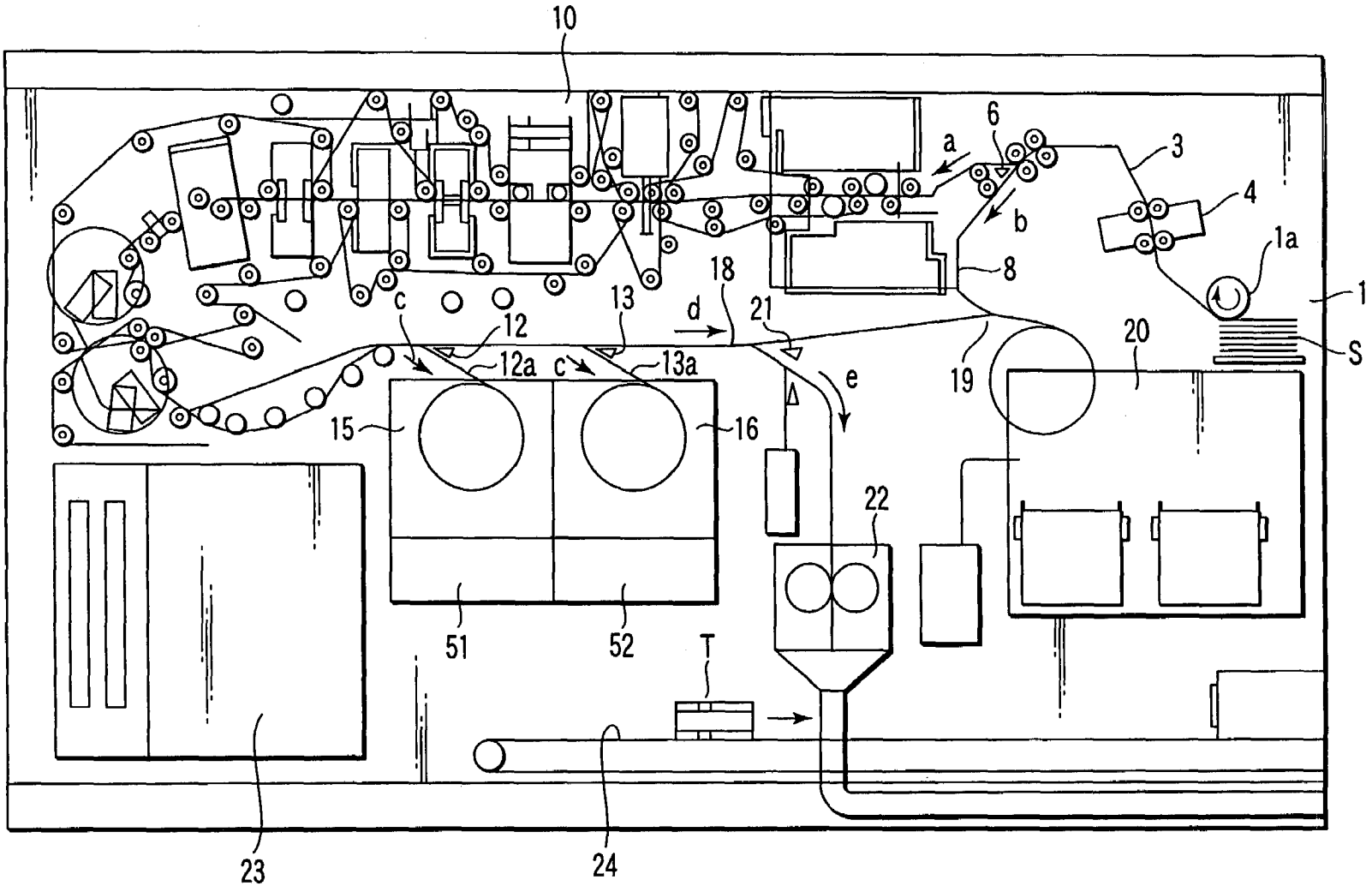
FIG. 1 is a schematic view diagrammatically showing a sheet material processing apparatus according to a first embodiment of the present invention.

FIG. 1 is a diagrammatic view showing a sheet material processing apparatus according to a first embodiment of the present invention. In FIG. 1, reference numeral 1 shows a sheet entry section for inserting sheet materials S in a stacked state. In the entry section 1, a pick-up roller la is provided for separating and picking up the sheet materials one by one from their top side.

The thus picked-up sheet S is conveyed along a conveying path 3. A sheet checking section 4 is provided at the conveying path 3 to check whether or not, for example, the sheets S are sent out in an overlapped state.

On the sheet sending-out side of the sheet checking section 4 a first sorting section 6 is provided for sorting the sheet toward first and second directions. The sheet which is sorted toward the first direction (a direction of an arrow a) is conveyed along the conveying path 3. The sheet which is sorted toward the second direction (a direction of an arrow b) is conveyed along a first reject conveying path 8.

A processing section 10 is provided at the conveying path 3 and has a plurality of detecting units over the conveying direction of the sheet. The processing section 10 decides whether, for example, the sheet is fit or unfit. Second sorting sections 12 and 13 are provided on a downstream side at the sheet conveying direction of the processing section 10 to allow the sheet to be sorted toward third and fourth directions.

At a third direction (a direction of an arrow c) along which the sheet is sorted by the second sorting sections 12 and 13 through branching paths 12*a* and 13*a* serving as a conveying device, first and second stacking devices 15 and 16 are connected to allow the sheet which is fit to be stacked in the first stacking device and the sheet which is soiled (not fit) to be stacked in the second stacking device. Below the first and second stacking devices 15 and 16, first and second sealing sections 51 and 52 are each arranged to seal a given number of (for example, 100) sheets in a small bundle. In the vicinity of the first and second sealing sections 51 and 52, a banding section 23 is provided by which a given number of (for example, 10) small bundle units are banded as a larger bundle unit. The larger bundle unit T banded by the banding section 23 is discharged on a belt conveyor 24 for delivery.

A second reject conveying path 18 is provided in a fourth direction (a direction of an arrow d) along which the sheet is sorted by the second sorting section 13. On the partway of the second reject conveying path 18, a third sorting section 21 is provided for sorting that sheet which is to be shredded toward a direction (a direction of an arrow e). The sheet which has been sorted toward the direction e is conveyed to a shredder 22. The terminating end of the second reject conveying path 18 is joined at a joining section 19 to the first reject conveying path 8 and a reject stacking section 20 is provided on a sheet delivery side of the joining section 19.

Now an explanation will be made below about the processing operation of the above-mentioned sheet material processing apparatus.

When the pick-up roller 1*a* is rotated, the sheets S on the sheet entry section 1 are sequentially separated and picked up one by one from their top side and conveyed along the conveying path 3. The sheet is conveyed at a predetermined speed to the sheet checking section 4 where various kinds of processing are performed on the sheet, for example, a decision is made whether or not the sheets are conveyed in an overlapped state.

If the sheets S are not conveyed in an overlapped state, the sheet is sorted by the first sorting section 6 toward the first direction as indicated by an arrow a and, if the sheets are conveyed in an overlapped state, the sheet is sorted toward the second direction as indicated by an arrow b.

The sheet S which has been sorted toward the first direction (a direction of an arrow a) is conveyed along the conveying path 3 to the processing section 10 where the contents of the sheet are decided for their genuineness. The sheet which has been sorted toward the second direction (a direction of an arrow b) is sent through the first reject conveying path 8 to the reject stacking section 20.

The sheet S which has been processed by the processing section 10 is sorted toward the third or fourth direction by the second sorting section 12 or 13 which is operated based on the processing information. That is, those sheets sorted by the second sorting section 12 or 13 toward the third direction (a direction c) are sent through the branching path 12*a* or 13*a* to the first stacking device 15 for a fit genuine sheet or to the second stacking device 16 for a soiled sheet to allow them to be stacked there. When a predetermined number of (for example, 100) sheets are, upon being stacked on the first and second stacking devices 15 and 16, sent onto the first and second sealing sections 51 and 52 where those sheets are sealed as a bundle unit. These sealed bundle units are sent to the banding section 23 and, when a predetermined number of (for example, 10) sealed bundle units are stacked there, these sealed bundle units are banded as a larger unit and delivered-on the conveying belt 24 toward an outside.

Where the sheet which has been sorted toward the fourth direction (a direction of an arrow d) is such as to be shredded, it is sorted by the third sorting section 21 to the shredding section 22 where it is shredded. Further, those sheets, counterfeit or illegible, which have been sorted in the fourth direction (a direction of an arrow d) are sent to the reject stacking section 20 for stacking.

Figure 2:
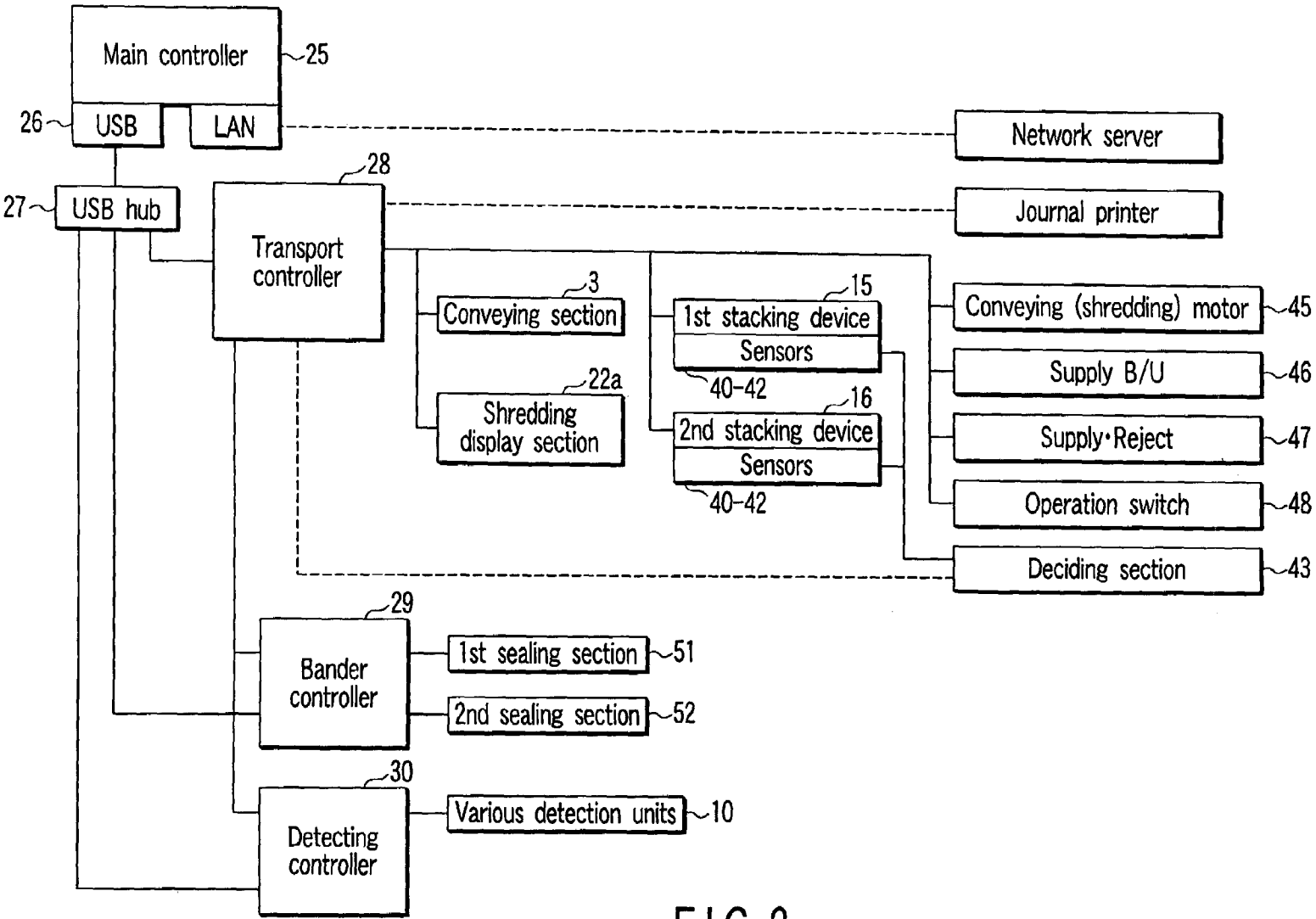
FIG. 2 is a block diagram showing a drive control system of the sheet material processing apparatus.

FIG. 2 is a block diagram showing a drive control system of the sheet material processing apparatus.

In FIG. 2, reference numeral 25 shows a main controller. To the main controller are connected, through a USB 26 and USB hub 27, a transport controller 28, a bonder controller 29 and detection controller 30 as a control device.

To the transport controller 28 are connected, through the control circuit, a conveying section 3 and shredding display section 22*a*, first and second stacking devices 15, 16 and sensors 40 to 42 according to the present invention, conveying (shredding) motor 45, supply B/U 46, supply-reject section 47 and operation switch 48. To the sensors 40 to 42, a deciding section 43 is connected to decide the states of the sheet material on the basis of the detecting of the sheet material by the sensors 40 to 42. The first and second sealing sections 51 and 52 are connected through the control circuit to the bander controller 30 and various detecting units 10.

Figure 3:
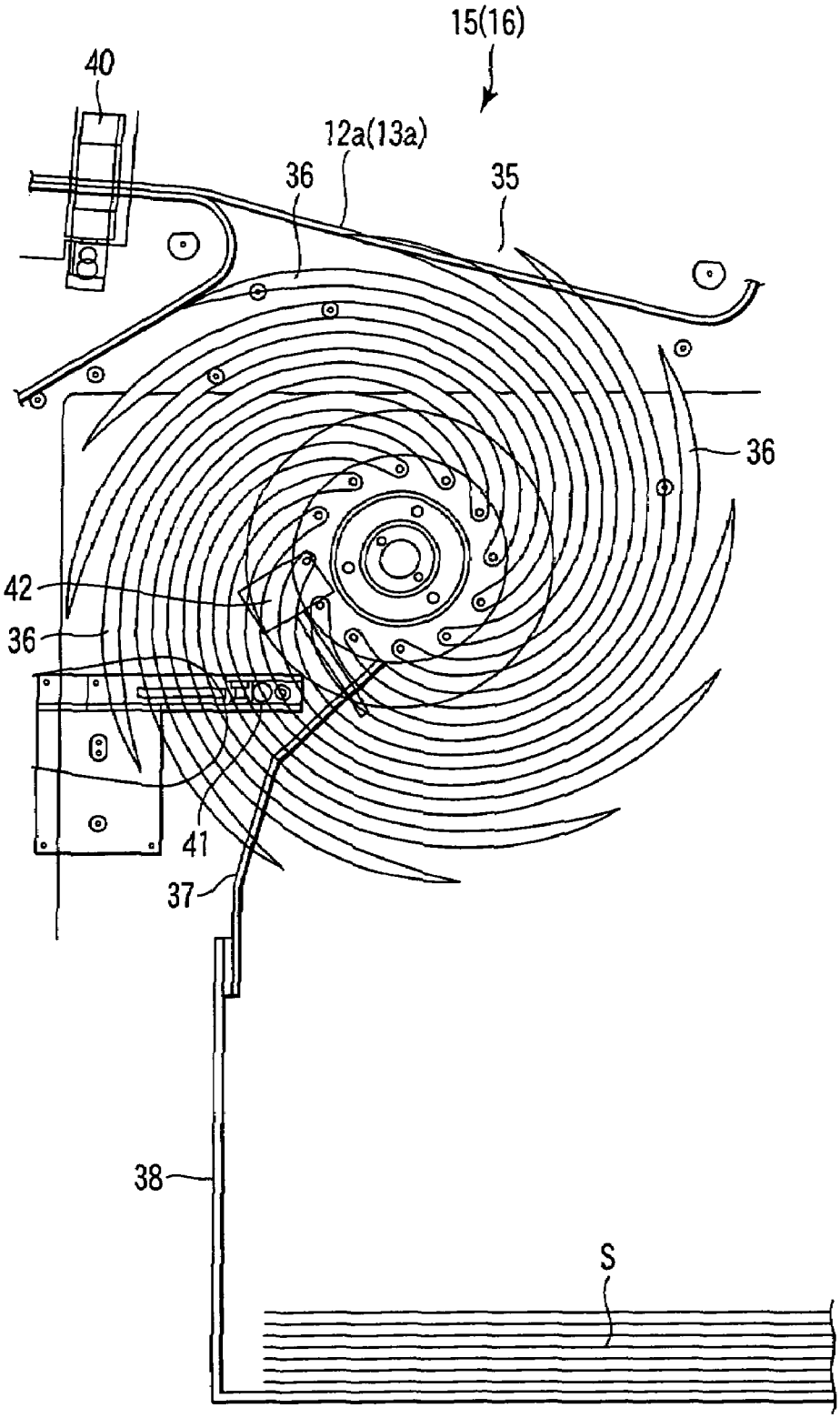
FIG. 3 is a schematic view showing the sheet material stacking apparatus.

FIG. 3 shows the first and second stacking devices 15 and 16 as set out above.

The first and second stacking devices 15 and 16 are of the same structure and an explanation will be made below by using the first stacking device 15 as a representative one.

The first stacking device 15 has a rotatable blade-type runner 35 at its top side. The runner 35 has 12 blades between which the sheet is inserted. The sheet inserted between the blades 36 and 36, while being slowing down its speed through the rotation of the runner 35, is guided downward. A scraping-out plate 37 serving as a scraping-out device is arranged in a nesting fashion on the lower side of the runner 35. The sheet while being guided downward through the rotation of the runner has its leading edge abutted against the scraping-out plate 37 to allow the sheet to be scraped out from between the blades 36 and 36 and dropped down. A stacking box 38 is provided below the runner 35 to allow the sheet which is dropped from between the blades 36 and 36 to be stacked therein and serves as a stacking section.

A shift sensor 40 serving as a first detection device is provided at the upper side of the runner 35 to detect the sheet conveyed by the branching path 12*a* (13*a*). Further, near the middle side of the runner 35, a blade checking sensor 41 is provided as a third detecting device for detecting the blade 36 and a drop-down checking sensor 42 is provided as a second detecting device for detecting an arrival of the sheet at the scraping-out plate 37.

As will be set out in more detail, the above-mentioned transport controller 28 is of such a type as to start the detecting of the sheet by the drop-down checking sensor 42 after the detection of the sheet by the shift sensor 40 but at a point of time at which the sheet arrives at the scraping-out plate 37 following the conveying of the sheet a predetermined distance through the rotation of the runner 35.

Figure 4:
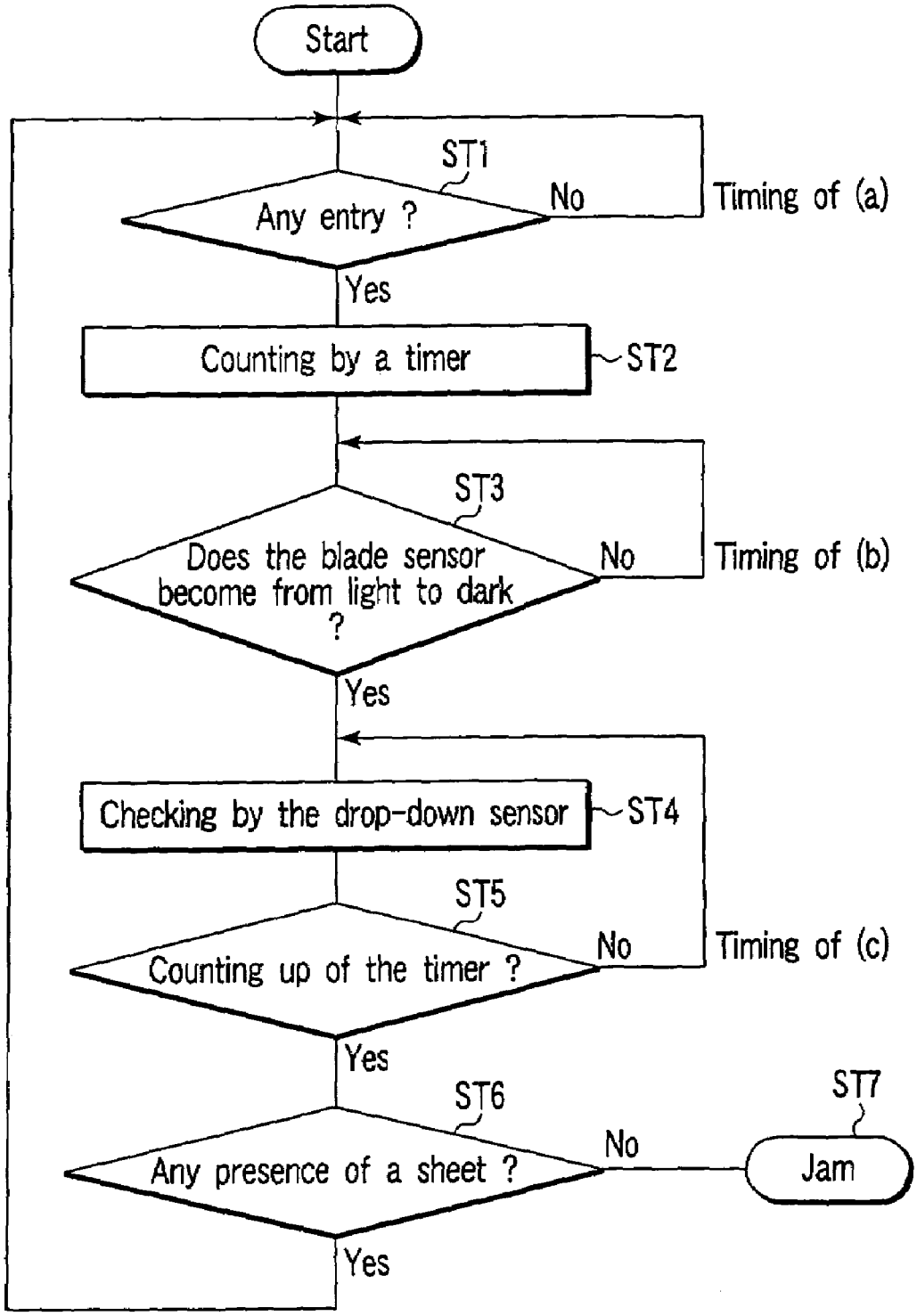
FIG. 4 is a flowchart showing a stacking operation of the sheet material stacking apparatus.
Figure 5:
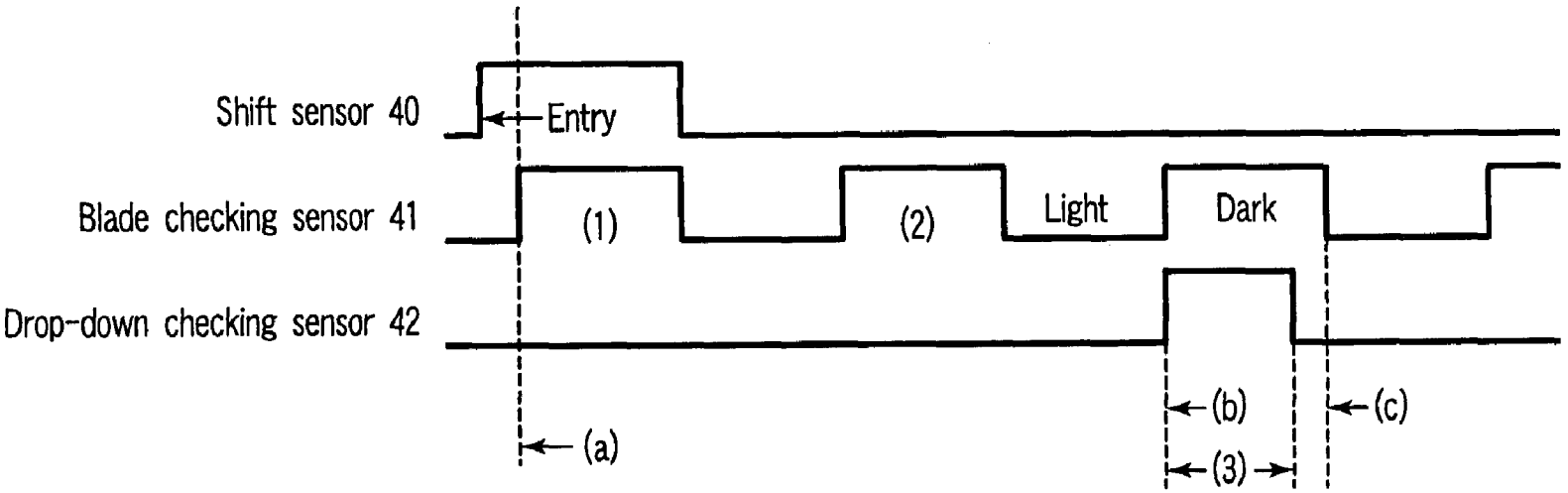
FIG. 5 is a timing chart showing the stacking operation of the sheet material stacking apparatus.

With reference to a flowchart of FIG. 4 and timing chart of FIG. 5, an explanation will be made below about the stacking operation of the sheets in the above-mentioned stacking device 15 (16).

The sheet which has been conveyed along the branching path 12*a* (12*b*) is detected by the shift sensor 40. When, after the detection of this, the leading edge of the sheet reaches the forward end of the blade 36 of the runner 35 (at a time point (a) in FIG. 5), a deciding section 43 decides whether or not the sheet is entered based on the detecting of a first blade 36 of the runner 35 by the blade checking sensor 41—step ST1. IfYES, the counting of a timer is made at step ST2. When, with the rotation of the runner 35, the blade 36 is rotated through an angle of 60° (at a time point in FIG. 5(*b*)), that is, after a time for the leading edge of the sheet to reach the forward end of the blade 36 from the entrance of the shift sensor 40 and, further, a time for the blade checking sensor 41 to detect the two blades 36 are passed, the deciding section 43 detects whether or not the blade checking sensor 41 becomes from light to dark—step ST3. If YES, the transport controller 28 starts the detecting of the sheet by the drop-down checking sensor 42 at step ST4. And it is decided whether or not the timer is counter up (step ST5). This decision is made in a FIG. 5(*c*) timing corresponding to the 75° rotation of the blade 36. If it is decided that the timer is counted up, it is decided whether or not any sheet is present, that is, whether or not any sheet reaches the scraping-out plate 37—step ST6. If it is decided that the sheet reaches the scraping-out plate 37, then a process of steps ST1 et seq. is again repeated. If it is decided that no sheet reaches the scraping-out plate 37, the occurrence of sheet jamming is displayed at step ST7 and any stacking operation is stopped by the transport controller 28.

According to this embodiment, as set out above, if it is decided that, after the detection of the sheet by the shift sensor 40, no sheet reaches the scraping-out plate 37 even if a predetermined time is passed, then the stacking operation of the sheet is stopped and it is, therefore, possible to positively prevent the sheets from being sealed in a bundle in the stacking box 38 in a shorter supply state than a predetermined number of sheets which would otherwise occur in the conventional apparatus.

Further, since the drop-down checking sensor 42 detect the reaching of the sheet in a given timing instead of detecting it at all times, it is possible to count the number of the sheets entered.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet material stacking apparatus comprising:

a conveying device configured to convey a sheet material;

a rotatable blade-type runner configured to allow the sheet which is conveyed by the conveying device to enter into a blade-to-blade space while being rotated and guide the sheet toward a predetermined direction;

a scraping-out device configured to allow the sheet which is guided through the rotation of the runner to abut thereagainst and scrape the sheet out of the blade-to-blade space;

a stacking section configured to allow the sheet which is scraped out by the scraping-out device to the stacked therein;

a first detecting device configured to detect the sheet which is conveyed by the conveying device;

a second detecting device configured to detect the sheet which reaches the scraping-out device through the rotation of the runner;

a control device configured to, after a passage of a predetermined time following the detection of the sheet by the first detecting device, start detecting the sheet by using the second detecting device, and to stop stacking the sheet when the second detecting device detects no sheets; and a third detecting device configured to detect the blade of the rotating runner, wherein, after the detection of the sheet by the first detecting device, the control device starts the detection of the sheet by the second detecting device based on the detecting of a predetermined number of, as detected by the third detecting device.

2. A sheet material stacking apparatus comprising:

a conveying device configured to convey a sheet material;

a rotatable blade-type runner configured to allow the sheet which is conveyed by the conveying device to enter into a blade-to-blade space while being rotated and guide the sheet toward a predetermined direction;

a scraping-out device configured to allow the sheet which is guided through the rotation of the runner to abut thereagainst and scrape the sheet out of the blade-to-blade space;

a stacking section configured to allow the sheet which is scraped out by the scraping-out device to the stacked therein;

a first detecting device configured to detect the sheet which is conveyed by the conveying device;

a second detecting device configured to detect the sheet which reaches the scraping-out device through the rotation of the runner; and a control device configured to, after a passage of a predetermined time following the detection of the sheet by the first detecting device, start detecting the sheet by using the second detecting device, and to stop stacking the sheet when the second detecting device detects no sheet, wherein the control device is such as to, after the detecting of the sheet by the first detecting device, start the detection of the sheet by the second detecting device from a point of time at which the sheet is conveyed a predetermined distance, and said predetermined distance is a distance obtained by adding a distance from the first detecting device to the forward end of the blade of the runner to a distance from the forward end of this blade to the scraping-out device.

* * * * *